United States Patent [19]

Bohacek

[11] Patent Number: 4,881,290

[45] Date of Patent: Nov. 21, 1989

[54] MOPS AND MOP FRAMES

[75] Inventor: Jan Bohacek, Lower Kingswood, England

[73] Assignee: Jani-Jack Limited, Surrey, England

[21] Appl. No.: 224,125

[22] Filed: Jul. 25, 1988

[30] Foreign Application Priority Data

Jul. 27, 1987 [GB] United Kingdom ..... 8717742

[51] Int. Cl.[4] ..... A47L 13/258

[52] U.S. Cl. ..... 15/228; 15/147 A; 15/229.6

[58] Field of Search ..... 15/147 R, 147 A, 147 B, 15/149, 228, 229.1–229.9

[56] References Cited

U.S. PATENT DOCUMENTS

| | | | |
|---|---|---|---|
| 2,840,840 | 7/1958 | Yamen | 15/147 R |
| 2,932,048 | 4/1960 | Yamen et al. | 15/147 R |
| 3,300,804 | 1/1967 | Benjamin | 15/147 A |
| 3,458,886 | 8/1969 | Goettel | 15/147 R |
| 4,783,873 | 11/1988 | Young | 15/147 A |

*Primary Examiner*—Edward L. Roberts
*Attorney, Agent, or Firm*—Hopgood, Calimafde, Kalil, Blaustein & Judlowe

[57] ABSTRACT

A folding mop frame has a pair of lateral outer sections pivoted on a central section of the frame and resiliently engagable by that central section to hold them extended with all the sections co-planar. On the upper faces of the lateral sections, near their outer ends, are S-form resilient hangers which grip the ends of a mop head extending around the ends of the frame and over its bottom face. Simply by applying a downwards force to the outer sections, they can be released from their engagement with the center section and swing downwards to leave the mop head hanging loosely, in which state it can easily be wrung out. Because of the resilient nature of the S-form hangers, they can ensure the mop head is held taut across the bottom of the frame independently of any shrinkage of the mop head material due to wetting.

14 Claims, 3 Drawing Sheets

MOPS AND MOP FRAMES

FIELD OF THE INVENTION

This invention relates to mops and more particularly to mops which comprise a frame on which a mop head is releasably held, and in particular to such mop frames.

BACKGROUND OF THE INVENTION

In one known form of frame for releasably holding a mop head, the frame has an oblong planar form for a correspondingly shaped mop head which lies against the underside of the frame. The frame is divided into two laterally opposed sections which overlap at the central region of the longer side of the frame and are pivoted to each other by a hinge near to, but off-set from, the centre of the longer side of the frame. When a manual catch is released, the frame sections can pivot relative to each other to a collapsed angular configuration for putting on and removing the mop head. On the upper face of the mop head, at each end of its longer sides, there is a pocket in which the ends of the frame fit when in its planar configuration. The mop head simply falls from the frame when the frame sections are collapsed and lie at an angle to each other. To take up the mop head again, the ends of the frame sections are slipped into the pockets before they are pivoted once more to their planar configuration to hold the head on the frame.

When using a mop, the mop head must be wrung from time to time to remove moisture from it. In this known form of mop it is necessary for the planar frame, with the mop head on it, to be placed between a pair of pressure plates. This is not a very efficient method of wringing, because the presence of the frame impedes the escape of moisture and makes it impossible to apply an even pressure to the material of the mop head. Moreover, the intensity of pressure that can be generated is limited because the force is applied over the entire area of the frame and mop head.

SUMMARY OF THE INVENTION

According to one aspect of the present ivnention, there is provided a mop frame for releasably holding a mop head, said frame comprising respective laterally oppositely projecting sections displaceable between a substantially coplanar extended configuration and a collapsed configuration by relative pivoting movement of the sections, the frame being arranged to hold a working region of a replaceable mop head against the bottom of the frame in the extended configuration of the frame sections, said sections being downwardly pivotable to a position in which their laterally outer ends lie close to each other, and in said position attachment means at the outer end regions of the frame sections are arranged to retain the mop head depending below the frame, whereby to permit a wringing device to apply pressure to the depending mop head while the mop head remains mounted on the frame.

Preferably the sections are resiliently secured in their co-planar configuration and are releasable from that resilient engagement by the application of a downwards moment about their pivots. This can provide a simple and effective way of allowing the frame to be collapsed for wringing of the mop head without requiring the user to handle the frame itself.

If a plate-like element extends over a substantial part of the plan area of each said frame section, this increases the effectiveness of which pressure can be applied when mopping and it also makes it easier to release the resilient engagement and pivot the sections downwards by a simple shaking movement of the mop. It is particularly preferred if a peripheral framing element of each section projects below that plate-like element. The provision of such relatively narrow projecting elements at the edges of the frame allows the user to apply an increased pressure to any stubborn stains or the like on the floor during mopping.

A further shortcoming that can be experienced with known forms of mop in which the mop head is held releasably on a frame, particularly those having an elongate frame and mop head, is shrinkage of the mop head material. With conventional absorbent textile materials shrinkage is inevitable in use, and may either lead to premature replacement of the mop head or may make the mop more difficult to use if the major dimension of the mop head (ie., its width laterally of the mop) varies to the extent that the head goes slack on the frame and slips about relative to the frame during mopping.

According to another aspect of the present invention, there is provided a mop frame for releasably holding the mop head, said frame comprising laterally oppositely projecting sections displaceable between a substantially co-planar extended configuration and a collapsed configurations by relative pivoting movement of the sections, the frame being arranged to hold a working region of a replaceable mop head against the bottom of the frame in the extended configuration of the frame sections, to hold the mop head on the frame, there being attachment means at opposite laterally outer regions of the frame that are resiliently deformable in the lateral direction, whereby the mop head can be held taut by said attachment means when the frame is in its extended configuration and the attachment means can yield in response to shrinkage of material of the mop head.

The provision of such attachment means is particularly suitable for holding the mop head on the frame in its collapsed state so that the working area of the mop head, normally held against the bottom face of the frame, depends below the frame.

By way of example, an embodiment of the invention will be described in more detail with reference to the accompanying drawings.

DESCRIPTION OF THE PREFERRED EMBODIMENT

Figure 1:
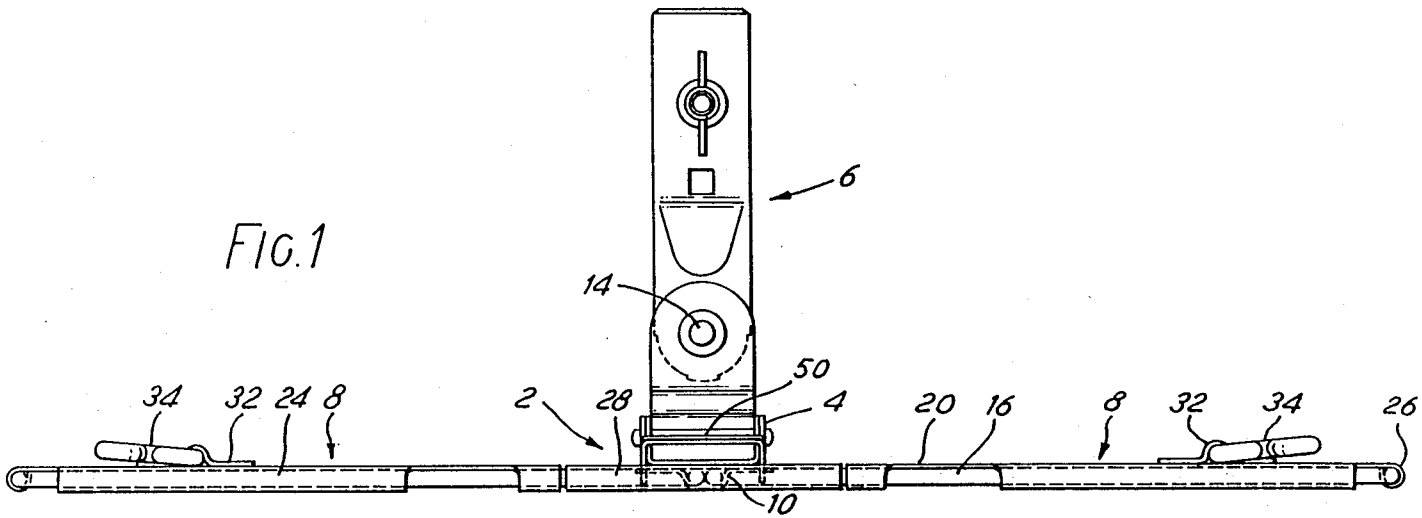
FIGS. 1 and 2 are a front view and a plan view from below of a mop frame according to the invention in its extended state.
Figure 2:
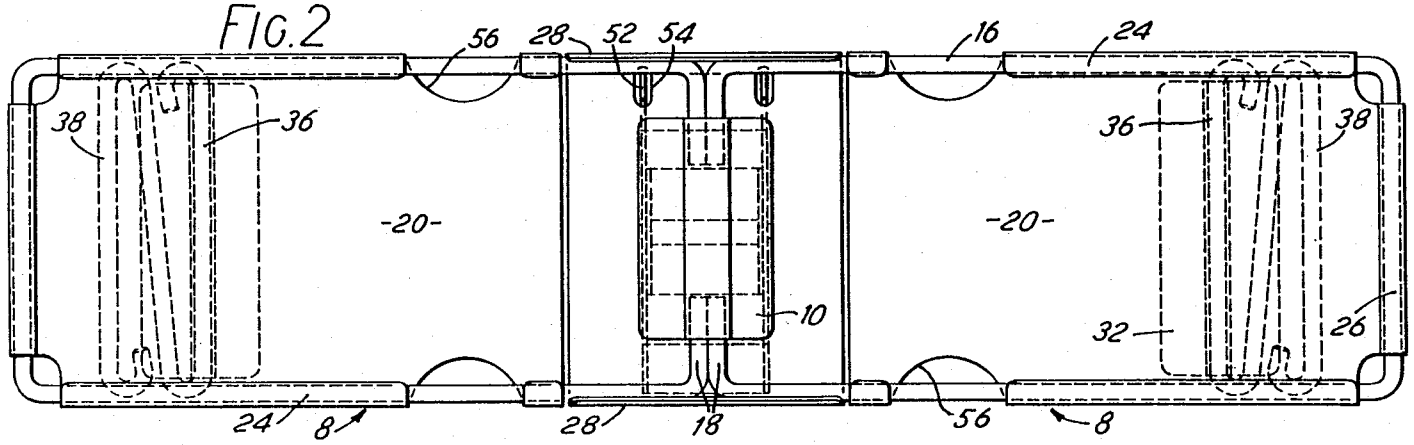

The mop frame shown is for a floor mop. It is preferably constructed from a corrosion-resistant metal and has an elongate rectangular plan form, symmetrical about a central vertical plane parallel to its shorter sides. It comprises three main sections, namely a short centre section 2 to the upper side of which is spot welded a bracket 4 to hold a socket 6 for a handle (not shown) of conventional form, and a pair of longer laterally outer sections 8 which are pivotally attached to the centre section through a bracket 10 spot welded to the underside of the centre section 2. The illustrated socket 6 is of generally conventional form, providing a universal joint between the frame and the handle, by means of mutually transverse pivot pins 12,14.

The construction of each outer section 8 comprises a metal rod bent to form a frame member 16 extending along the front and rear edges and the outer lateral edge of the section and terminating at the inner end in a pair of short, co-axial projections 18 that are held by the bracket 10. A plate member 20 on the upper side of the frame member 16 fills substantially the whole of its plan area beyond the centre section 2. The front and rear edges and the outer lateral edge of the plate member are rolled over the frame member to form securing lips 24,26 extending generally parallel to the upper surface of the plate member.

The centre section 2 is formed from a metal plate with front and rear edges rolled over to define lips 28 engaging the adjoining portions of the frame members 16 but having a lesser overlap than the lips 24,26, in fact extending inwardly for less than the full diameter of the rod section. As a result, although the outer plate members 20 are permanently fixed to their frame members 16, the ends of the frame members held in the rolled-over lips 28 of the centre section can be sprung inwards to release them from the lips 28 and so allow the outer sections to be pivoted on the centre bracket 10 between the alternative configurations shown in the drawings.

Near the outer edges of the outer sections further brackets 32 are welded to the upper faces of the plate members 20 for spring hangers 34 which hold the mop head 36. These are S-form metal rods with parallel inner and outer arms 36,38, the inner arm 36 of each hanger being held pivotally in its bracket 32. The mop head comprises an absorbent textile pad 40 with a cloth backing, and tufts or loops 42 projecting from its inner surface co-extensive with the plan area of the spread mop frame. At opposite ends of the pad there are sleeves 44 that extend parallel to the outer ends of the frame and that are slipped onto the free outer arms 38 of the hangers 34 to attach the mop head to the frame.

It is arranged that when the frame sections are extended and the mop head is spread, the mop head is held under tension by the hangers 34. The hangers themselves are able to yield resiliently under the tension load and their S-form ensures that the outer arms remain substantially parallel. To help maintain this parallel relationship, the two hangers are mounted in mirror image to each other. It may be noted here that the resilience of the hangers also allows them to yield to help take up any shrinkage of the mop head backing in use.

Figure 5:
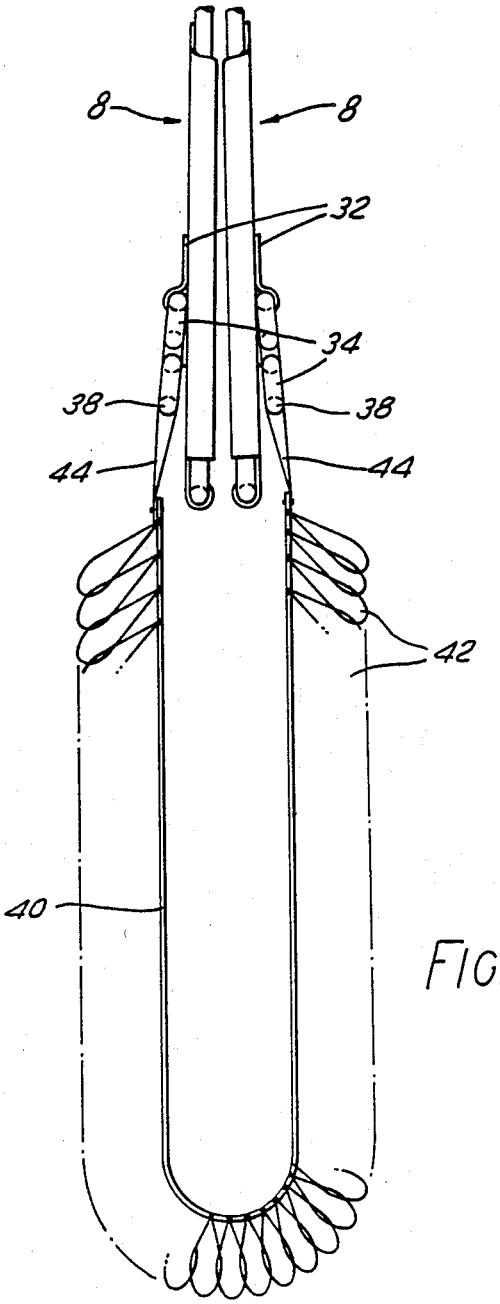
FIG. 5 is a view similar to FIG. 3 showing the mop head depending from the frame in its collapsed state.

When the frame is folded, as is shown in FIG. 5, the mop head will depend loosely from the hangers 34 and the whole area of the tufted pad that makes up the mopping surface under the frame in use will hang free below the frame. It is therefore possible to use known wringing mechanisms, such as those that have a pair of rollers that can be pressed together, to wring out the mop head without obstruction by the frame. Such machines are able to apply very high wringing pressures to achieve a corresponding high degree of moisture removal.

Figure 3:
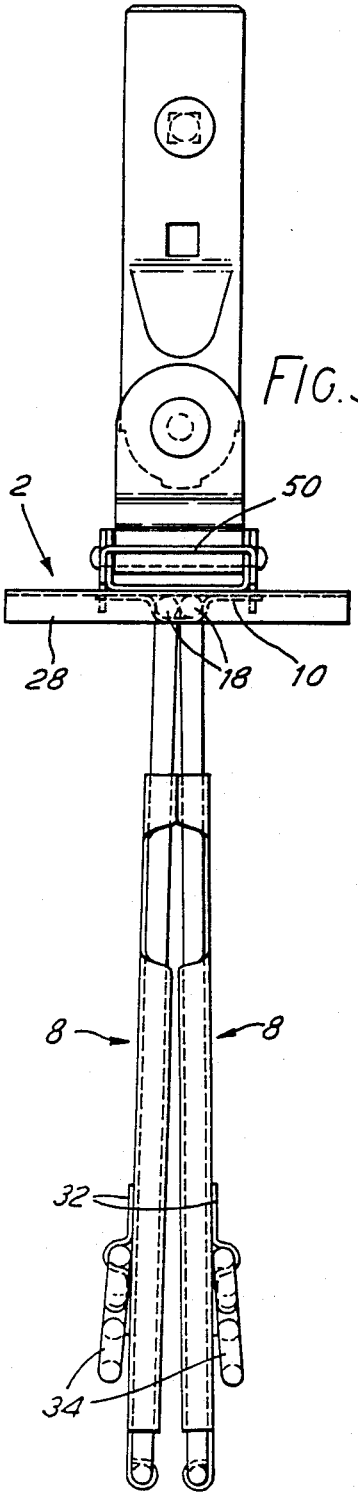
FIG. 3 and 4 are front and side views of the frame in a collapsed state.
Figure 4:
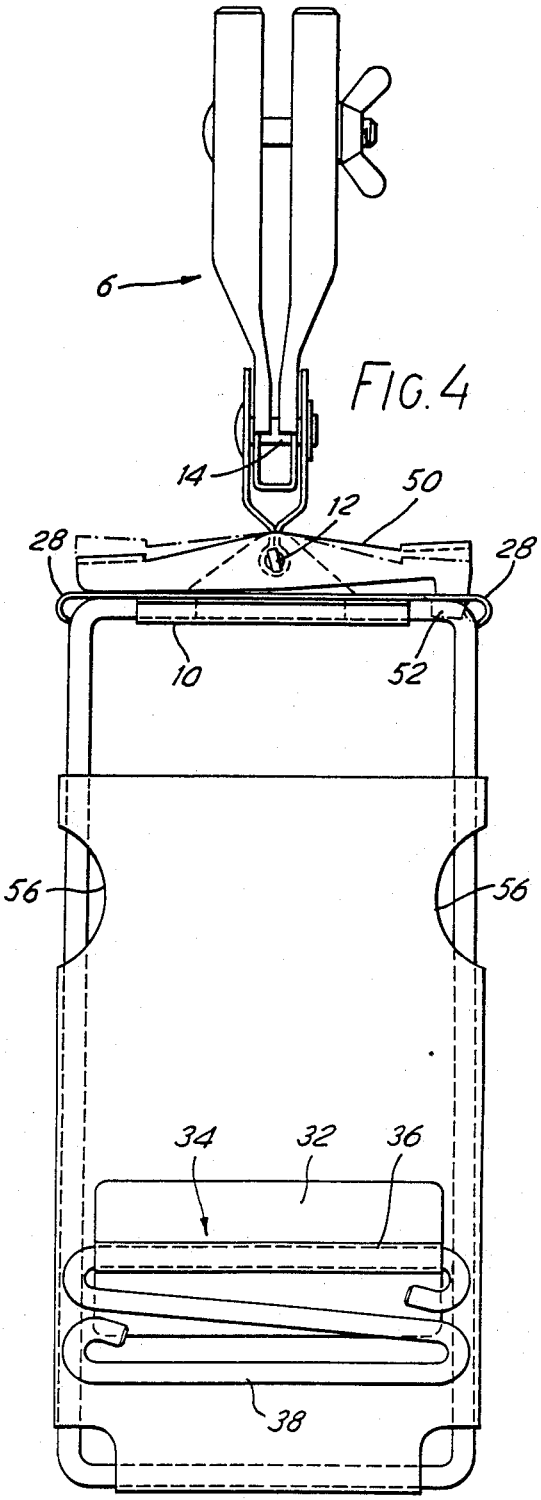

In use, the mop head can be easily attached to the hangers 34 with the frame collapsed as in FIGS. 3 to 5. If the upright mop is then rotated about the axis of the handle and lowered towards the floor, the outer sections will fly out by centrifugal force to a partly open position and as they are brought down onto the floor they will be forced further apart to the fully extended state in which the rolled-over lips 28 of the frame centre section snap over the frame members of the outer sections to secure the frame in its planar configuration with the mop head held firmly under tension.

The frame sections can be locked in position by a foot-operated catch 50 mounted on the pivot pin 12. The catch comprises a pair of spurs 52 that can project through openings 54 in the centre section 2. When the catch is pivoted on the pin 12 to lower the spurs 52 through the openings, the spurs are located against the frame member 16, preventing the flexure of the member to release it from the engaging lip 28. By pressure on one end or the other of the catch, the spurs 52 can be lowered through or raised from the openings 54 to engage and disengage the catch.

When the mop head is to be wrung out, with the catch 50 disengaged, the mop is lifted from the floor and given a brisk shake vertically, ie., transverse to the plane of the frame. The inertia of the outer sections easily overcomes the resilient engagement of their frame members by the centre section lips 28 and so they fall to the collapsed state. The mop head, still held by the hangers, is left hanging loosely below the frame as shown in FIG. 5, and can then be placed in the wringer mechanism. It will be noted that both spreading and folding of the frame are achieved without having to handle the frame or the mop head. Should the release of the outer sections become obstructed for any reason, however, cut-outs 56 in the plate members 20 of the outer sections allow the frame members 16 to be squeezed manually to release them from the lips 28 of the centre section for folding the frame.

It can be seen that the plate members 2,20 of the mop frame extend over virtually the entire plan area. They thus provide a planar backing for the mop head, making it easier for the user to apply pressure to the surface being cleared. At the periphery of the frame the rolled lips 24–28 project below the main area of the plate members and allow local high pressures to be applied to remove stubborn soiling with a greater force than would be possible if the mop head were backed by uniform planar support.

I claim:

1. A mop frame comprising a pair of frame sections, said sections being in laterally opposed relation and taking up an essentially co-planar extending configuration in a generally horizontal working position, pivot means on the frame, mutually adjacent end regions of said frame sections being engaged by said pivot means, remote from said adjacent regions opposite end regions of the frame sections each extending in cantilever manner in said extended configuration, said sections being downwardly pivotable on the pivot means to bring said opposite end regions towards each other to assume a collapsed configuration, attachment means at said opposite end regions of the frame sections for attaching a mop head to the frame, said attachment means being resiliently deformable in the lateral direction, whereby the mop head can be held taut by the attachment means when the frame sections are in their extended configuration and the attachment means can yield in response to shrinkage of the material of the mop head.

2. A mop frame according to claim 1 wherein said attachment means comprise arms extending substantially parallel to each other for engaging the mop head.

3. A mop frame according to claim 2 wherein said arms extend in cantilever manner whereby the mop head can be slid off the arms when the frame sections are in their collapsed configuration.

4. A mop frame according to claim 3 wherein said attachment means comprise generally S-form unitary members at the respective opposite end regions of the frame sections.

5. A mop frame according to claim 1 wherein a face of the frame that is directed upwardly with the frame in said working position has said attachment means mounted thereon and spaced inwardly from the opposite lateral limits of the frame.

6. A mop frame according to claim 1 comprising resilient securing means for holding the frame sections in their co-planar configuration, said securing means having a holding force such that the frame sections are released from said configuration by the application to them of a downwards moment about their pivots.

7. A mop frame according to claim 6 comprising locking means for retaining the sections in their extended configuration.

8. A mop frame according to claim 1 wherein each frame section comprises a plate-like element that extends over at least a substantial part of the plan area of its frame section.

9. A mop frame according to claim 8 wherein each section has a peripheral framing element that depends below the plate-like element of the section.

10. A mop frame comprising a centre portion, pivot means on said centre portion, a pair of laterally opposite frame sections connected to the centre portion through said pivot means, said sections being releasably locatable in an essentially co-planar extended configuration, to assume a generally horizontal working position, attachment means on said sections for releasably holding a mop head on the frame with a working region of the mop head being located against the bottom of the frame in said working position, said sections being downwardly pivotable on said pivot means from said extended configuration to a collapsed configuration in which said ends of the frame sections lie close to each other, each frame section comprising a plate-like element that extends over at least a substantial part of the plan area of its frame section, and each section having a peripheral framing element that depends below the plate-like element of the section.

11. A mop frame according to claim 10 comprising resilient securing means for holding the frame sections in their co-planar configuration, said securing means having a holding force such that the frame sections are released from said configuration by the application to them of a downwards moment about their pivots.

12. A mop frame according to claim 11 comprising locking means for retaining the sections in their extended configuration.

13. A mop frame according to claim 10, wherein said attachment means are provided on each said plate-like element for holding the mop head on the frame.

14. A mop frame according to claim 13, wherein said attachment means retain the mop head depending from the frame in said collapsed configuration, whereby to permit a wringing device to apply pressure to the depending mop head while the mop head remains mounted on said attachment means.

* * * * *